US005483214A

United States Patent [19]

Perreira et al.

[11] Patent Number: 5,483,214

[45] Date of Patent: Jan. 9, 1996

[54] ARMATURE POSITION SENSOR FOR A RELAY

[75] Inventors: G. Stephen Perreira, Carpinteria; Richard L. Kutin, Camarillo; Lanny V. Griffin, Davis, all of Calif.

[73] Assignee: Kilovac Corporation, Carpinteria, Calif.

[21] Appl. No.: 233,627

[22] Filed: Apr. 26, 1994

[51] Int. Cl.[6] ..... H01H 9/00

[52] U.S. Cl. ..... 335/205

[58] Field of Search ..... 335/17, 78–86, 335/154, 202, 205, 206, 207

[56] References Cited

U.S. PATENT DOCUMENTS 3,205,323 9/1965 Deshautreaux, Jr. .
3,218,506 11/1965 Williams et al. .
3,302,588 2/1967 Bennett .
3,560,846 2/1971 Bessko .
3,579,159 5/1971 Posey .
3,770,919 11/1973 Lewis .
5,128,641 7/1992 Posey .

*Primary Examiner*—Lincoln Donovan
*Attorney, Agent, or Firm*—Christie, Parker & Hale

[57] ABSTRACT

A sensor for use with high-power solenoid-actuated relays, and for detecting and signalling relay armature position and hence the actuation state of the relay. The sensor is external to a sealed chamber in which the relay contacts and armature system are positioned, and includes a permanent magnet, the flux path of which includes the relay armature and base. Armature movement to close the relay alters the flux path to operate a reed switch adjacent the magnet, and the condition of the reed switch signals the unactuated or actuated state of the relay.

9 Claims, 5 Drawing Sheets

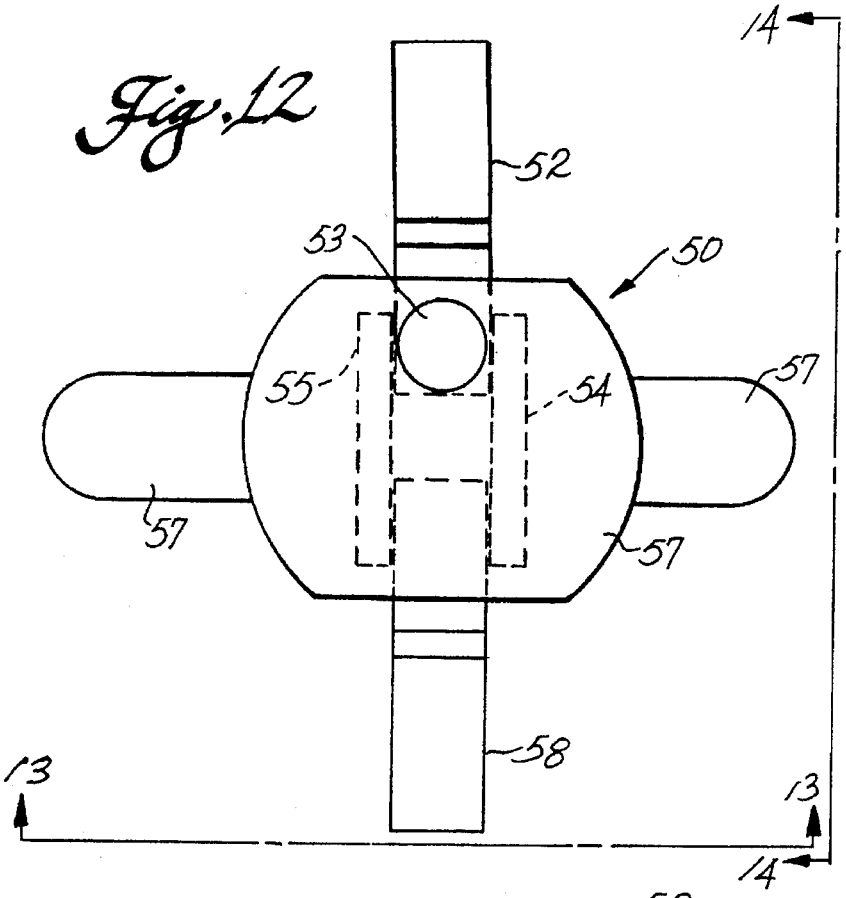
Fig. 12
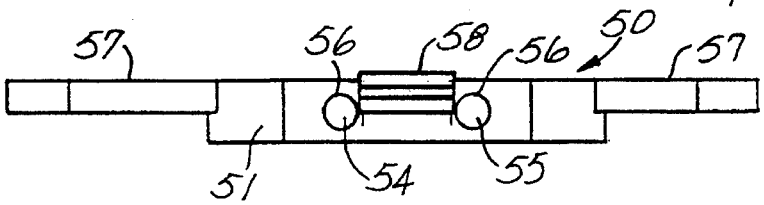
Fig. 13
Fig. 14
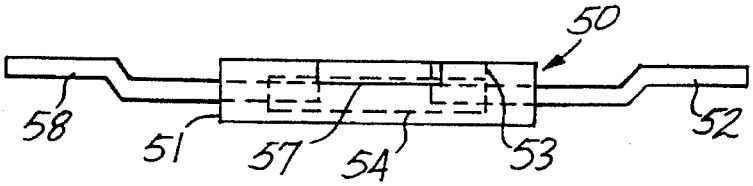

ARMATURE POSITION SENSOR FOR A RELAY

BACKGROUND OF THE INVENTION

Magnetically operated relays are used for switching of electrical current, and typically have a wire coil which, when electrically energized, creates a magnetic field to move an armature which in turn drives a movable contact into connection with one or more fixed contacts to complete a circuit. Relays are highly reliable devices which have many uses, but verification of proper armature movement is desirable in certain critical applications such as military equipment, and where high voltages and currents are being switched.

For example, a type of relay called a high-voltage direct-current power contactor may be used for switching currents in excess of 1000 amperes at voltages of 200–300 volts or more. Heavy-duty switches of this type typically position the fixed and moving contacts in an air-free sealed enclosure or chamber which is evacuated to a high vacuum, or evacuated and backfilled with an insulating gas such as nitrogen. The objective is to minimize arcing and localized contact melting (which can result in unwanted welding of the fixed and movable contacts) as the contacts make or break during high-current switching. Sealing of the contacts also isolates them from any corrosive or otherwise adverse external environment which might degrade conductivity of the contacts.

Preferably, all of the moving components of this type of relay or contactor are within the sealed chamber to eliminate need for a bellows or similar device for transmitting movement from the outside into the sealed environment. This configuration, however, prevents use of a simple external motion sensor which could be used to verify correct positioning of the armature (and hence of the moving contact or contacts). It is also desirable to isolate the motion sensor both electrically and mechanically from the high-voltage environment within the sealed enclosure or chamber.

This invention meets these objectives by providing a magnetically actuated armature-position sensor which can be mounted as a module on the exterior of the switching relay or contactor. The sensor incorporates a simple low-power on-off reed switch to provide an electrical indication of armature position. No penetration of the high-vacuum or backfilled sealed contact chamber is needed, and the sensor is readily adapted to use on a variety of existing relay or contactor designs.

SUMMARY OF THE INVENTION

This invention is directed to a sensor for detecting whether the armature of a sealed relay is in an actuated or unactuated position. The movable armature, as well as movable and fixed contacts of the relay, are within a sealed chamber, preventing use of a sensor which is mechanically linked to the armature. The sensor uses an auxiliary permanent magnet secured by a ferromagnetic yoke to a ferromagnetic base of the relay, and the flux path of the magnet includes the base and the armature. When the armature is in a first unactuated position close to the permanent magnet, the flux path is substantially confined to the high permeability path of the yoke, base and armature. When the armature is solenoid driven to a second actuated position which is more removed from the magnet, the flux path is altered to create a fringing field adjacent the magnet. One of the ferromagnetic contacts of a reed switch is positioned in the fringing field so the contacts are open when the armature is in the first position, and closed in the second actuated position. The reed-switch contacts can be incorporated in any desired circuit to provide an electrical indication of armature position, and hence of the open or closed state of the relay contacts.

DESCRIPTION OF THE DRAWINGS

FIG. 12 is a plan view of an alternative embodiment of the sensor;

FIG. 13 is a view on line 13—13 of FIG. 12;

FIG. 14 is a view on line 14—14 of FIG. 12; and

DESCRIPTION OF THE PREFERRED EMBODIMENTS

Figure 2:
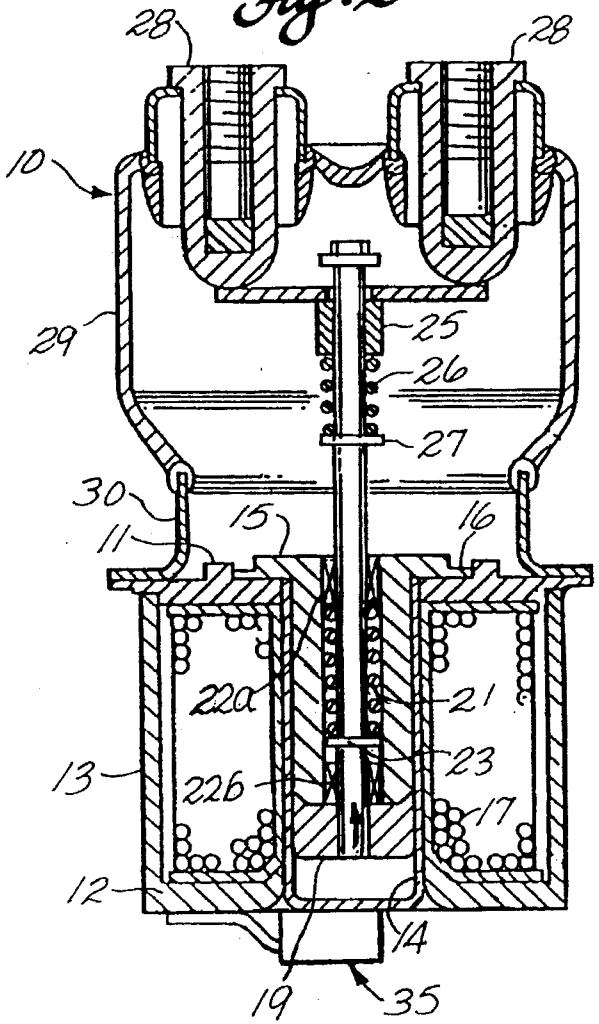
FIG. 2 is a view similar to FIG. 1, but with the relay actuated.

The armature position sensor of this invention is useful with many different types of moving-armature relays and contactors, and will be described in terms of use with a heavy-duty sealed contactor 10 shown in FIGS. 1–3. This contactor is fully described in published PCT Application PCT/US92/02545 (Publication No. WO 92/17897 of Oct. 15, 1992), and will accordingly here be only briefly described in terms of identifying principal components.

Contactor 10 is a solenoid-actuated switch with a cylindrical base 10A made of ferromagnetic metal, and including circular top and bottom walls 11 and 12 which are joined by a sidewall 13. A cup-shaped and upwardly open non-magnetic (e.g., stainless steel) hollow tube 14 is secured to walls 11 and 12, and extends through central circular openings in the walls. A magnetic circuit is completed by a hollow tubular central polepiece or stator 15 fitted in tube 14, and having a radially extending flange 16 fitting over and secured to upper wall 11. A solenoid actuating coil 17 is wound in the annular space between sidewall 13 and tube 14.

An armature assembly 18 has a ferrous-metal armature 19 slidably mounted in the closed end of tube 14, and secured to a shaft 20 extending upwardly through a central bore in stator 15. A compression coil spring 21 is positioned between an upper bushing 22A fixed to the stator and a washer 23 fixed to the shaft, the spring forcing the unactuated armature to a normally "off" position (FIG. 1) against the closed end of tube 14. A lower bushing 22B is also fixed to the stator, and the bushings stabilize the shaft. A circular disk-shaped movable contact 24 has a central hub 25 adjacent an upper end of shaft 20, and free to rotate on the shaft. A second compression coil spring 26 is fitted on the shaft between hub 25 and a washer 27 which is axially fixed and rotatable on the shaft.

A pair of spaced-apart fixed contacts 28 are secured and sealed to a generally cylindrical dielectric (ceramic or glass) envelope 29 which is secured at its lower end to top wall 11 by a flange 30. Top wall 11, sidewall 13, and bottom wall 12 of the base, together with tube 14, envelope 29 and flange 30, enclose a sealed interior chamber 31 which is typically evacuated to a high vacuum, or evacuated and backfilled with an arc-suppressing gas. All of the contacts and movable components (including the entire armature assembly) of the contactor are thus within chamber 31, whereas coil 17 is outside of the sealed space.

Figure 3:
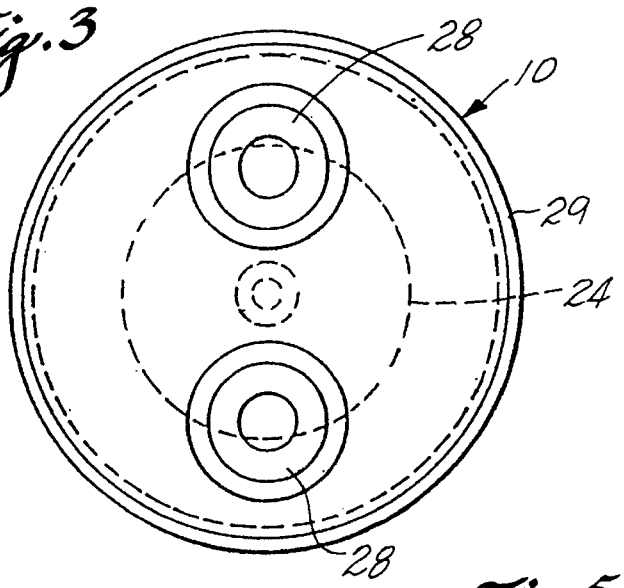
FIG. 3 is a top view of the relay.

Contactor 10 is shown in FIG. 2 in an "on" position in which coil 17 is energized, creating a strong magnetic field which drives armature 19 against stator 15 to close movable contact 24 against fixed contacts 28. In this position, the upper flanged end of shaft 20 is moved beyond its seated position against the movable contact, and energy is stored in further compressed springs 21 and 26. When coil current is cut off to open the switch, immediate initial movement of shaft 20 resulting from expansion of spring 26 propels the flanged shaft end against the still-closed movable contact to provide an "impact break" acceleration of the movable contact away from the fixed contacts to minimize contact-separation arc formation when high currents are being switched.

Figure 1:
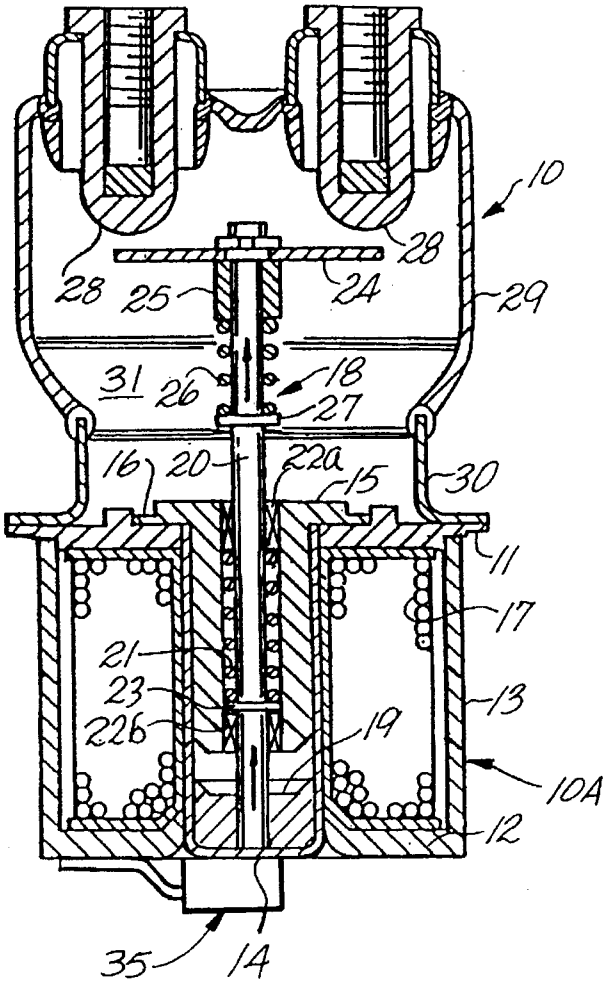
FIG. 1 is a sectional elevation of a conventional relay in an unactuated condition.

An external (i.e., external to sealed chamber 31) armature position sensor 35 according to the invention is shown in FIGS. 1–2 as secured to the base of contactor 10, and is illustrated in detail in FIGS. 4–7. The sensor has a bracket-like ferrous-metal yoke 36 with a first end 37 secured to the contactor base, a downwardly angled central section 38, and second end 39 which is spaced apart from the closed lower end of tube 14. A small permanent magnet 40 (polarity is indicated on FIG. 4) is secured to second end 39 to be sandwiched in tight engagement between the second end and the closed end of tube 14 at a position which is radially spaced from the longitudinal axis of shaft 20. Magnet 40 is preferably of high-intensity type such as made from a samarium-cobalt alloy.

A reed switch 41 is fitted in a mating bore of a dielectric plastic block 42 which is secured around second end 39 of the yoke and magnet 40. Reed switches are well-known commercially available devices, and typically consist of a sealed tubular glass housing 43 having thin and flexible reed-like ferromagnetic contacts 44 and 45 extending from opposite housing ends toward and centrally overlapping each other. The contacts are normally separated in an "off" position, but are closed together by application of an external magnetic field.

Figure 4:
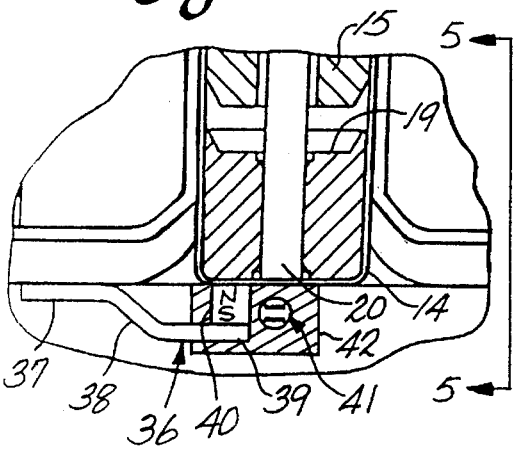
FIG. 4 is a fragmentary sectional view of a base portion of the relay of FIGS. 1–3, and showing a sensor according to the invention.
Figure 5:
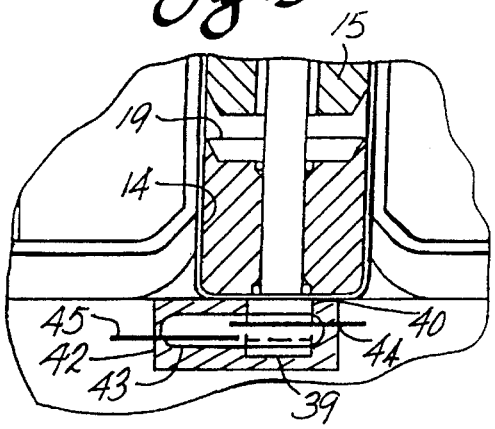
FIG. 5 is a view on line 5—5 of FIG. 4.
Figure 6:
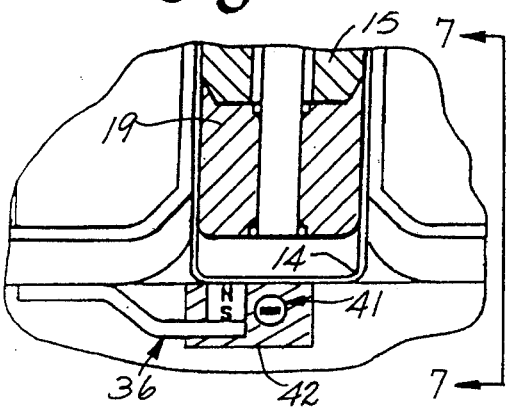
FIG. 6 is a view similar to FIG. 4, but with the relay actuated.
Figure 7:
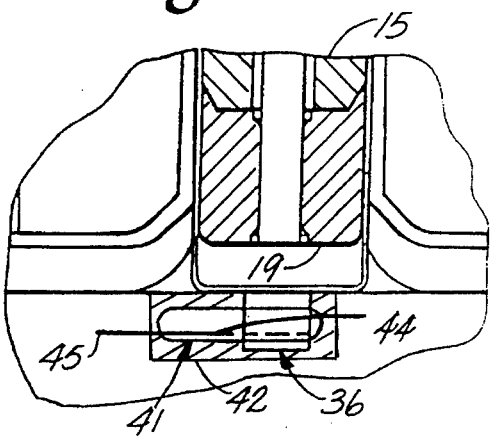
FIG. 7 is a view on line 7—7 of FIG. 6.

Proper positioning of the reed switch with respect to magnet 40 is important, and as shown in FIGS. 4–5, the longitudinal axis of the reed switch is slightly spaced from (e.g., by about 0.050 inch) the magnet and the end of yoke second end 39. Of even greater importance is an axial offsetting of the reed contacts from the magnet (FIG. 5) such that contact 44 is subject to a fringing flux field from the magnet, but contact 45 is substantially outside the field. The contacts would not close if subject to the same field, but the offset positioning makes contact 44 a moving contact which can be closed against the unaffected contact 45.

Figure 8:
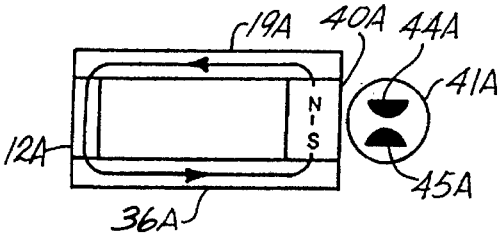
FIGS. 8 and 9 are flux-path diagrams illustrating the principles of the invention.
Figure 9:
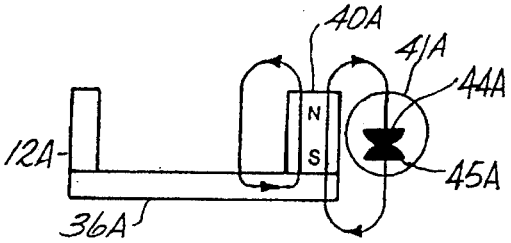

The operation of the sensor is most easily explained by reference to FIGS. 8–9 showing magnetic circuits analogous to the corresponding magnetic loops of contactor 10 and sensor 35 in unactuated (FIG. 8) and actuated (FIG. 9) conditions. The magnetic circuit includes a ferromagnetic iron bar 36A analogous to yoke 36, a second iron bar 12A analogous to bottom wall 12, a third and movable iron bar 19A analogous to armature 19, and a fourth bar magnet 40A corresponding to magnet 40. A reed switch 41A (seen in axial section to display contact position) is positioned adjacent magnet 40A.

When contactor 10 is in an unactuated "off" condition, armature 19 is bottomed in tube 14 to form a closed magnetic circuit corresponding to the analogous closed magnetic loop depicted in FIG. 8. In this condition, the field of magnet 40–40A is substantially confined to the closed magnetic circuit, and does not affect the normally open reed-switch contacts. Actuation of the contactor drives armature 19 upwardly against stator 15 (FIG. 2), opening the magnetic loop as shown in FIG. 9. In this condition, the distribution of magnetic flux is markedly altered as indicted by the flux arrows in FIG. 9. Contact 44A is now immersed in fringing magnetic flux of magnet 40A, causing that contact to move against contact 45A to close the reed switch. The reed switch thus opens or closes to signal corresponding armature positioning in the unactuated or actuated positions.

Figure 10:
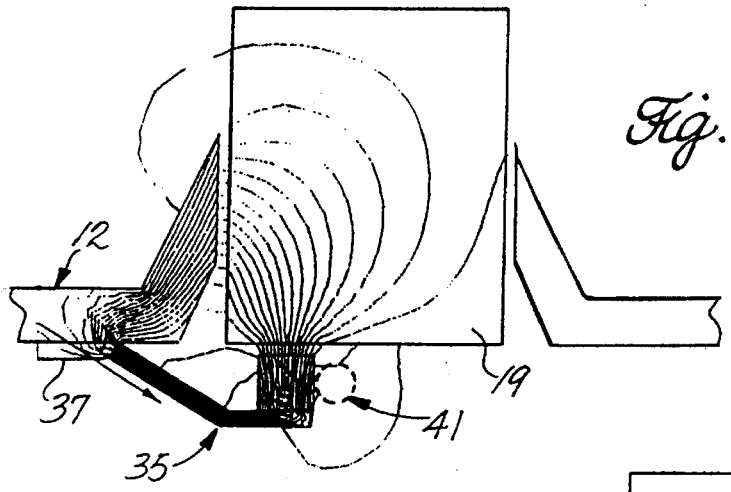
FIGS. 10 and 11 are plots of magnetic flux in the sensor and relay when the relay is unactuated and actuated, respectively.

FIG. 10 is a plot of magnetic flux in sensor 35 when contactor 10 is in an unactuated "off" condition. The plot was based on a finite-element analysis of a two-dimensional model, and it shows the flux as substantially confined to the high-permeability path through armature 19, base 10A, and yoke 36, this path being interrupted only by the bottom and sidewall of non-magnetic tube 14. There is very little fringing flux around reed switch 41, and the switch remains open.

Figure 11:
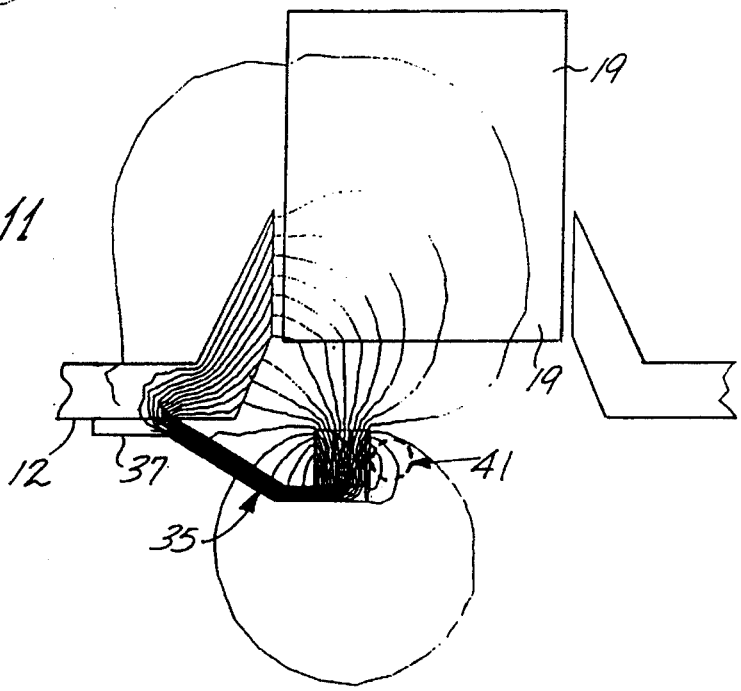

FIG. 11 is a plot corresponding to FIG. 10, but with the contactor actuated to raise armature 19 away from the contactor base, and thereby to close movable contact 24 against the fixed contacts. The separation of the armature from the base alters the flux pattern, and a significantly intensified fringing field now envelopes contact 44 of reed switch 41 to close the switch. The reed switch can be incorporated in any desired circuitry to provide local or remote indication of contactor armature position, and hence the open or closed condition of the contactor.

Importantly, the field generated by direct-current energization of coil 17 must be in the same direction as the field of magnet 40. Use of a simple steering diode with the coil provides the needed polarity sensitivity. Reverse-polarity energization of the coil could result in an unwanted fringing field and a false signal from the sensor in the event of the armature becoming stuck in the unactuated position with the coil energized.

FIGS. 12–14 show an alternative embodiment of the invention as a sensor 50 having a dielectric plastic body 51 (glass-filled polythalamide is suitable). A ferromagnetic yoke 52 (corresponding to yoke 36) is secured in and extends from one side of body 51, and a circular permanent magnet 53 is secured on the top of the yoke inner end. A pair of reed switches 54 and 55 are mounted in parallel bores 56 in the body, and positioned on opposite sides of magnet 53 immediately adjacent the magnet. As was the case with sensor 35, the reed switches and magnet are offset to insure that fringing flux of the magnet affects only one of the switch contacts. If desired, body 51 may include a pair of mounting tabs 57 for use in securing the sensor to a contactor or relay base.

Another feature of sensor 50 which is equally useful in sensor 35 is the addition of a second ferromagnetic shielding yoke 58 embedded in body 51 between reed switches 54 and 55, and extending from the body oppositely away from yoke 52 for attachment to bottom wall 12. The shielding yoke is offset from the switches as shown in FIG. 12 to be adjacent the stationary contacts of the reed switches which are substantially outside the fringing field of magnet. The purpose of the shielding yoke is to provide a high-permeability flux path which shields or shades the stationary contacts from external magnetic fields, and from any leakage field created when the relay coil is energized. Stated differently, the shielding yoke provides improved common-mode noise rejection with respect to "noise" stray fields which might otherwise affect the stationary contacts.

Figure 15:
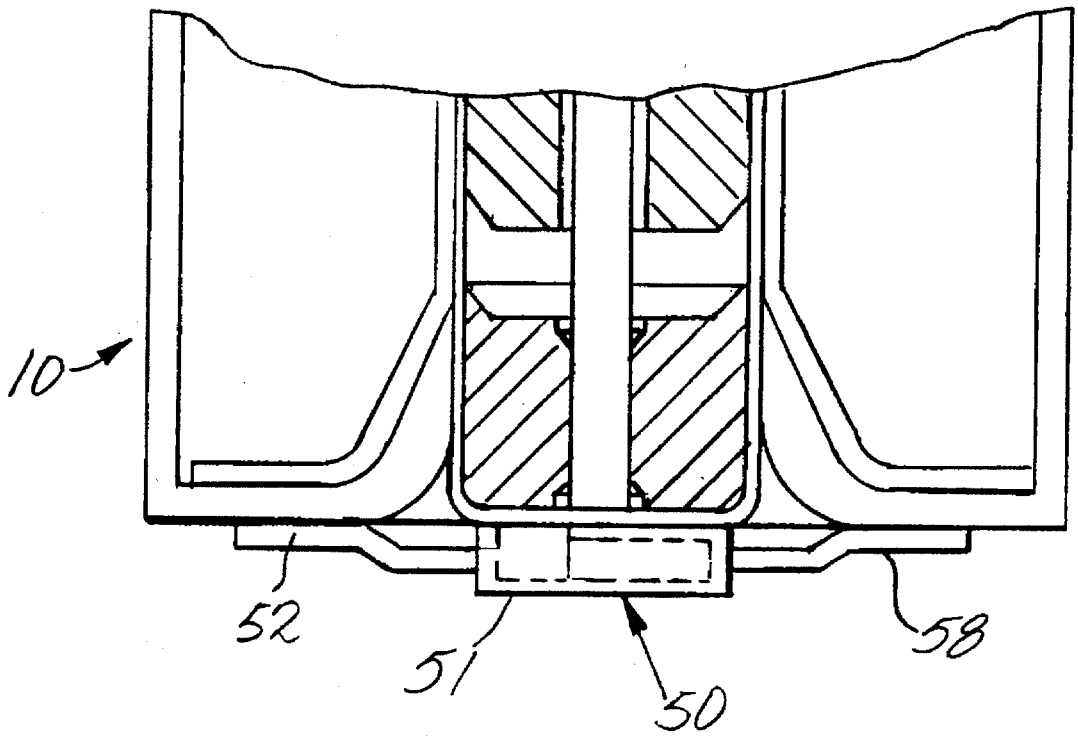
FIG. 15 is a sectional elevation of the sensor of FIGS. 12–14 as mounted on a relay.

FIG. 15 shows sensor 50 as installed on the base of contactor 10. The positioning of the sensor and the resulting flux paths are just as already described for sensor 35. The use of dual reed switches provides a redundancy safety factor in critical applications to insure highly reliable signalling of contactor armature position.

There has been described a sensor for detecting armature position and hence contact condition in solenoid-activated contactors and other power relays. The sensor is isolated from the high currents and voltages being switched responsive to armature movement in the contactor, and provides reliable contact-closure signalling of contactor condition.

What is claimed is:

1. An armature position sensor for use with a solenoid-actuated sealed relay having fixed and movable contacts, a ferromagnetic base and an armature movably mounted in the base and connected to the movable contact, a coil in the base and surrounding the armature to move the armature from a first position to a second position to close the fixed and movable contacts when the coil is activated, and a dielectric housing sealed to the base to form a sealed chamber which contains the armature, movable contact, and fixed-contact surfaces which mate with the movable contact when the armature is in the second position, the sensor comprising:

a permanent magnet adapted to be positioned against an exterior surface of the base to be adjacent the armature when the coil is not activated;

a ferromagnetic yoke adapted to be secured to the base and magnet to form a magnetic-circuit flux path from the magnet through the armature, base and yoke, a field of the magnet being substantially confined to the flux path when the armature is in the first position, and being altered to form a fringing field adjacent the magnet when the armature is moved to the second position to close the relay contacts; and a magnetically actuated switch positioned adjacent the magnet in the fringing field, and actuated by the fringing field when the armature is in the second position.

2. The sensor defined in claim 1 in which the permanent magnet, yoke, and switch are wholly external with respect to the sealed chamber.

3. The sensor defined in claim 2 in which the switch is a reed switch.

4. The sensor defined in claim 3 in which the reed switch has first and second contacts, the first contact being movable by the fringing field, and the second contact being substantially unaffected by the fringing field.

5. The sensor defined in claim 4 in which the sealed-relay chamber is evacuated.

6. The sensor defined in claim 4 in which the sealed-relay chamber is filled with an arc-suppressing gas.

7. The sensor defined in claim 4, and further comprising a ferromagnetic shielding yoke adapted to be secured to the base, and positioned adjacent the second contact to shield the second contact from stray magnetic fields.

8. The sensor defined in claim 2 in which the switch comprises a pair of parallel reed switches positioned adjacent and on opposite sides of the magnet, each reed switch having a pair of contacts, one of which is movable by the fringing field, and the other being substantially unaffected by the fringing field.

9. The sensor defined in claim 8, and further comprising a ferromagnetic shielding yoke adapted to be secured to the base, and positioned adjacent said unaffected contacts to provide shielding from stray magnetic fields.

* * * * *